US005588678A

United States Patent [19]

Young

[11] Patent Number: 5,588,678

[45] Date of Patent: Dec. 31, 1996

[54] TALKING TRADING CARD

[75] Inventor: Steven R. Young, Dallas, Tex.

[73] Assignee: Great Western Press, Inc., Dallas, Tex.

[21] Appl. No.: 403,637

[22] Filed: Mar. 14, 1995

Related U.S. Application Data

[63] Continuation-in-part of Ser. No. 265,961, Jun. 27, 1994.

[51] Int. Cl.[6] ..... B42D 15/00

[52] U.S. Cl. ..... 283/67; 446/302

[58] Field of Search ..... 283/56, 67, 117, 283/904; 379/355; 273/460, 439; 446/297, 302

[56] References Cited

U.S. PATENT DOCUMENTS

| | | | |
|---|---|---|---|
| 3,876,865 | 4/1975 | Bliss | 283/904 X |
| 3,886,327 | 5/1975 | Dobosi | 283/904 X |
| 4,409,471 | 10/1983 | Aigo | 283/904 X |
| 4,719,140 | 1/1988 | Hara et al. | 283/904 X |
| 4,822,990 | 4/1989 | Tamanda et al. | 283/904 X |
| 5,181,744 | 1/1993 | Betheil | 283/904 X |

*Primary Examiner*—Willmon Fridie, Jr.
*Attorney, Agent, or Firm*—Jones, Day, Reavis & Pogue

[57] ABSTRACT

A talking trading card having two printed trading cards attached to the top and bottom sides of a substrate in which is housed the mechanism for powering, storing, activating, and emitting recorded sounds. The sounds may be prerecorded in a voice chip or may be programmed into the voice chip after the manufacture of the unit through a receptacle placed on the side of the unit.

7 Claims, 1 Drawing Sheet

TALKING TRADING CARD

This is a continuation-in-part application of co-pending application Ser. No. 08/265,961 filed Jun. 27, 1994 and having the same title and inventor as the present application.

BACKGROUND OF THE INVENTION

1. Field of the Invention

The present invention relates to trading cards in general and in particular to a trading card having thereon indicia relating to a particular person, place, object, or character or a plurality thereof and which also has voice and other sounds stored in a well-known voice chip. The voice and/or sounds are related to the indicia depicted on the face of the card and can be heard by selectively activating the self-contained circuitry coupled to the voice chip.

2. Description of Related Art

Trading cards are well known in the industry today and typically include sports figures such as football players, baseball players and the like or places such as the Grand Canyon, the Hanging Gardens of Babylon and the like or objects of interest such as birds, animals, and, more recently, cartoon characters such as those from prominent cartoon movies. They are printed using conventional and current printing techniques and are typically printed on both sides using multiple colors and sometimes are combined with foil stamping, embossing, or coatings. These cards are packaged and distributed to the public for sale. They are purchased by individuals interested in the particular indicia on the cards.

SUMMARY OF THE INVENTION

The present invention is designed to offer a new dimension to the trading card industry and the consumer alike. It comprises a trading card having particular indicia thereon and having stored therein in a voice chip, voice and/or other sounds that are related to the indicia on the face of the card. For instance, if a prominent football player were featured, the voice of the football player could be heard with a particular message that could include background noise of a crowd cheering. The voice could be that of a cartoon character depicted on the face of the card or a description of a bird depicted on the face of the card, including a description of the bird, its habitat and the like. Any desired information could be stored that is to be audiblized and which relates to the particular indicia shown on the face of the card. This makes the cards extremely attractive because very personal information can be made available to the user, including the voice of the prominent athlete who maybe depicted on the face of the card.

Thus, the principal object to the present invention is to provide a trading card which gives the consumer the ability to activate and listen to a recorded message or sound that may be repeated as oft as the user desires so long as the power source permits.

Another object of thee present invention is to provide means associated with the trading card such that the message or sounds can be recorded after the card has been manufactured.

Thus, the present invention relates to a talking trading card comprising a substrate housing, a printed trading card attached to each side of the housing and having indicia thereon pertaining to a particular person, place, object, or animated character such as a cartoon character or multiple such persons, places, objects, or cartoon characters, a voice chip in said substrate housing for providing a predetermined message that is related to the primed indicia on the face of the card, terminals for receiving power to energize the voice-chip circuit, loudspeaker means in the housing and coupled to the voice-chip circuit for providing the stored message audibly, and a switching device coupled to the voice-chip circuit for selectively causing the voice-chip circuit to provide the predetermined message to the loudspeaker.

BRIEF DESCRIPTION OF THE DRAWINGS

These and other objects and advantages of the present invention will be more fully disclosed when taken in conjunction with the following DETAILED DESCRIPTION OF THE DRAWINGS in which like numerals represent like elements and in which.

DETAILED DESCRIPTION OF THE DRAWINGS

Figure 1:
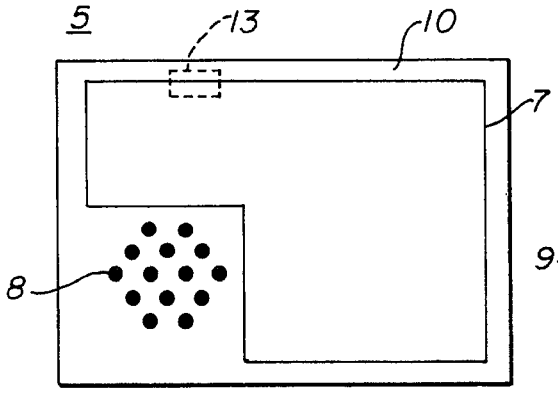
FIG. 1 is a top perspective view of the front of the novel card.

Referring now to FIG. 1, a plan view of the top of the novel trading card 5 is shown and comprises an upper trading card 10 having an area 7 on which indicia is printed representing a person, place, object, or character such as a cartoon character. Orifices 8 are formed in the upper card 10 to receive the voice or audible messages from a loudspeaker as will be explained hereafter. A switch 13, shown in phantom lines, which may be any well-known type of switch such as a pressure-sensitive switch, is located within the card and can be used to activate the circuitry as will be shown hereafter in relation to FIG. 4.

Figure 2:
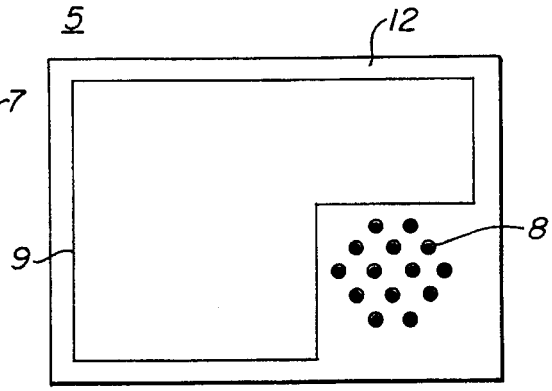
FIG. 2 is a perspective view of the back of the novel talking trading card.

FIG. 2 is a bottom view of the novel trading card 5 and, again, has a bottom trading card surface 12 with an area 9 in which indicia may be printed and, again, has orifices 8 associated with the loudspeaker as will be shown hereafter to provide the audible message or sounds.

Figure 3:
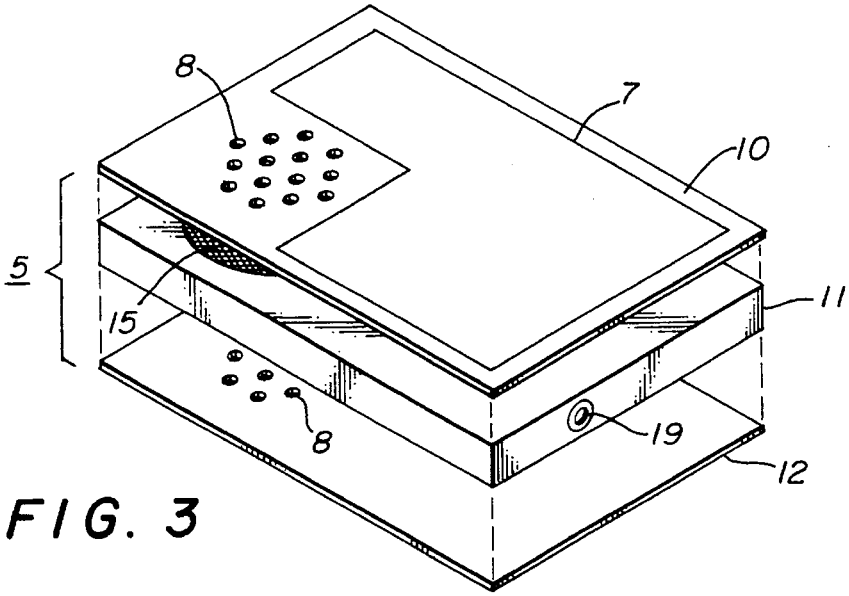
FIG. 3 is an exploded, side perspective view of the invention illustrating the arrangement of the substrate housing and the printed trading cards for attachment to each side thereof.

FIG. 3 is an exploded view of the novel card illustrating the top surface 10, the bottom surface 12, and the electronic module 11 sandwiched there between. The trading card surfaces 10 and 12 may be laminated to the electronic module 11 in any well-known manner. A loudspeaker 15 may be associated with the orifices 8 in the upper and lower trading card surfaces 10 and 12. A jack 19 is provided in the electronic module 11 such that the voice chip 17, shown in FIG. 4, can be programmed after the novel trading card has been manufactured.

Figure 4:
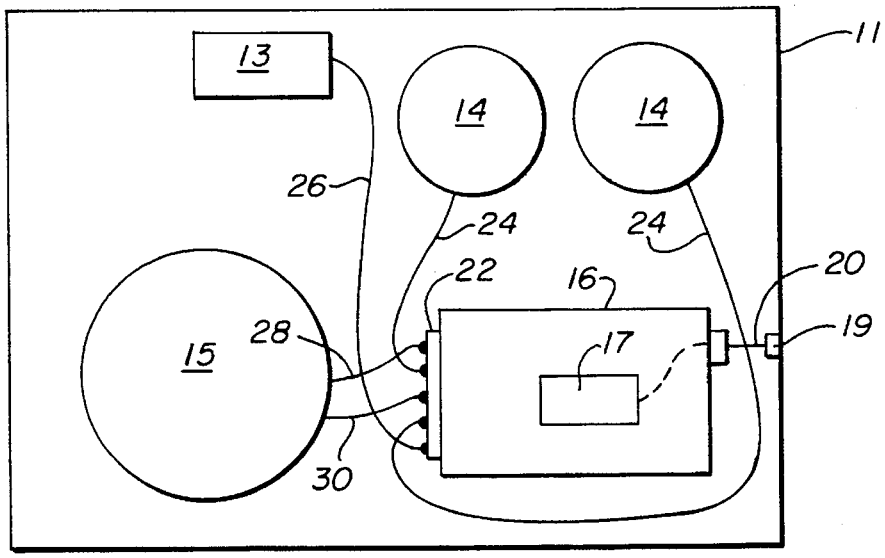
FIG. 4 is a top plan view of the novel trading card with the top face removed to show the circuitry and complements contained therein.

As shown in FIG. 4, the top trading card phase 10 has been removed exposing the electronic substrate housing 11 in which a printed circuit 16 containing a voice chip 17 is mounted. As stated previously, through jack 19, which is connected to the voice chip 17 through line 20, the unit may have whatever information desired programmed into the voice chip 17 after the unit has been completely manufactured. Voice chip 17 is standard in the art and is available as a shelf item. It may be an accessible ROM that has the information stored therein in digital form. Other types of memories well known in the art allow the information to be programmed into the chip such as through jack 19.

Batteries 14 provide power to the printed circuit 16 through leads 24 coupled to connector panel 22. In like manner, the voice chip 17 output is coupled through leads 28 and 30 to the loudspeaker 15 from the appropriate terminals on connector panel 22.

The switch 13, which may be a pressure-sensitive switch well known in the art and placed within the card, may be used to selectively couple the batteries 14 to the printed circuit 16 to cause the voice chip 17 to provide an output to the speaker 15 for the user's benefit. The information can be replayed as many times as desired by activating switch 13 so long as power remains in the batteries 14.

Thus, there has been disclosed a novel trading card having indicia on one or both sides thereof and having a message stored within a voice chip that relates to the indicia printed on the trading card surfaces. The indicia may be voice sounds, music and the like as desired so long as it relates to the indicia printed on one or both of the surfaces of the trading card. The voice chip may be preprogrammed and inserted in the unit during manufacture or it may be inserted in the item during manufacture and programmed through an external jack after the unit has been completely assembled.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. A method of providing a consumer with information concerning a particular subject with the use of a talking trading card comprising the steps of:

providing a substrate housing having a top and a bottom side;

attaching a trading card surface to each side of said housing;

providing indicia on at least one of said trading card surfaces pertaining to a person, place, object, or cartoon character;

providing a voice-chip circuit in the housing for storing a predetermined voice message that is related to the printed indicia to create a talking trading card;

energizing the voice chip through power terminals thereon;

coupling a loudspeaker means in the housing to the voice-chip circuit for generating the message audibly; and coupling switch means to the voice-chip circuit for selectively causing the voice-chip circuit to provide the consumer with the predetermined talking trading card voice message through the loudspeaker.

2. A method as in claim 1 further comprising the step of preprogramming a voice chip in the voice-chip circuit with the talking trading card message related to the printed indicia prior to the voice chip being provided in said housing.

3. A method as in claim 1 further comprising the steps of:

providing an electrical terminal jack on the substrate housing external surface; and connecting the terminal jack to the voice chip such that the voice chip can be programmed with the talking trading card message relating to the indicia after the manufacture of the talking trading card.

4. A method as in claim 1 further including the step of relating the indicia and talking trading card message to athletes.

5. A method as in claim 1 further including the step of relating the indicia and talking trading card message to mammals such as horses, birds, and the like.

6. A method as in claim 1 further including the step of relating the indicia and talking trading card message to places such as the Grand Canyon, ancient ruins, and the like.

7. A method as in claim 1 further including the step of relating the indicia and talking trading card message to animated characters such as cartoon characters.

* * * * *